US007119747B2

(12) United States Patent
Lin et al.

(10) Patent No.: US 7,119,747 B2
(45) Date of Patent: Oct. 10, 2006

(54) MULTI-BAND ANTENNA

(75) Inventors: Hsien Chu Lin, Tu-chen (TW); Lung Sheng Tai, Tu-chen (TW); Chen-Ta Hung, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,333

(22) Filed: Dec. 28, 2004

(65) Prior Publication Data

US 2005/0190108 A1 Sep. 1, 2005

(30) Foreign Application Priority Data

Feb. 27, 2004 (TW) ..... 93202864 U

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 6,759,990 B1 * 7/2004 Rossman ..... 343/700 MS
6,816,127 B1 * 11/2004 McKivergan et al. ..... 343/895
6,844,853 B1 * 1/2005 Tai et al. ..... 343/700 MS
6,861,986 B1 * 3/2005 Fang et al. ..... 343/700 MS
2003/0222823 A1 12/2003 Flint

* cited by examiner

*Primary Examiner*—Tho Phan
(74) *Attorney, Agent, or Firm*—Wei Te Chung

(57) ABSTRACT

A multi-band antenna (1) used in an electronic device and formed of a metallic sheet by defining holes therein, including a first radiating portion (30), a second radiating portion (31), a third radiating portion (32), a ground portion (2), and a coaxial transmission line (4). The first radiating portion, the ground portion and the coaxial transmission line cooperatively form a loop antenna operated at a higher frequency band of about 5.15–5.875 GHz. The second radiating portion, the ground portion and the coaxial transmission line cooperatively form a first inverted-F antenna operated at another higher frequency band of about 5.725–5.875 GHz. The third radiating portion, the ground portion and the coaxial transmission line cooperatively form a second inverted-F antenna operated at a lower frequency band of about 2.4–2.5 GHz.

18 Claims, 8 Drawing Sheets

MULTI-BAND ANTENNA

BACKGROUND OF THE INVENTION

1. Field of the Invention

The present invention relates generally to an antenna, and more particularly to a multi-band antenna for use with an electronic device.

2. Description of the Prior Art

The prosperous development of wireless communication industry brings various products and techniques for multi-band communication such that many new products have the performance for wireless communication so as to meet the consumers' demand. Such products as WLAN cards with antennas on/in them for use with a laptop computer or a personal digital assistance (PDA) are gaining popularity in wireless communication market. These cards benefit from multi-band antennas operated under IEEE 802.11a/b/g standard. In most cases, embedded multi-band antennas are arranged in an electronic device directly, rather than via a WLAN card. Whatever, a multi-band antenna with small size and high performance is essential and critical to achieve the purpose for wireless communication.

A series of dual-band antennas embedded within electronic devices are disclosed in U.S. patent application Publication No. 2003/0222823, including slot-slot antenna, PIFA-PIFA antenna, and PIFA-slot antenna, and so on. Take a general architecture of a PIFA-PIFA antenna for example. The dual-band antenna 700 comprises a first radiating element comprising components 702 and 703, and a second radiating element comprising components 704 and 708. The first and the second radiating elements are connected to a ground element 701. An antenna feed is preferably implemented using a coaxial transmission line 706, wherein an inner conductor 705 of the coaxial transmission line is connected to the first radiating element, and an outer conductor 707 of the coaxial transmission line is connected to the ground element 701. The antenna 700 operates in a lower frequency band of about 2.4 GHz to about 2.5 GHz under IEEE 802.11b/g and a higher frequency band of about 5.15 GHz to about 5.35 GHz under IEEE 802.11a. However, the antenna cannot be used in another frequency band of 5.75–5.825 GHz which is also under IEEE 802.11a standard. Moreover, the lower and the higher frequency bands of the antenna are narrow, which restrains the application of the antenna. Additionally, the second radiating element of the antenna is fed though coupling, rather than by the coaxial transmission line directly, which reversely affects the antenna gain.

Hence, in this art, a multi-band antenna with wide bandwidth to overcome the above-mentioned disadvantages of the prior art will be described in detail in the following embodiments.

BRIEF SUMMARY OF THE INVENTION

A primary object, therefore, of the present invention is to provide an multi-band antenna with wide bandwidth for operating in wireless communications under IEEE 802.11a/b/g standard.

A multi-band antenna used in an electronic device and formed of a metallic sheet by defining holes therein, comprising a first radiating portion, a second radiating portion, a third radiating portion, a ground portion, and a coaxial transmission line. The first radiating portion, the ground portion and the coaxial transmission line corporately form a loop antenna operated at a higher frequency band of about 5.15–5.875 GHz. The second radiating portion, the ground portion and the coaxial transmission line corporately form a first inverted-F antenna operated at another higher frequency band of about 5.725–5.875 GHz. The third radiating portion, the ground portion and the coaxial transmission line corporately form a second inverted-F antenna operated at a lower frequency band of about 2.4–2.5 GHz.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

A multi-band antenna 1 according to the present invention is used in an electronic device for transmitting and receiving electromagnetic signals. In this preferred embodiment, the electronic device is a laptop computer (not shown). The antenna 1 is integrally made up of a metallic sheet via setting slots therein. Said metal sheet can be a bracket, which is settled between a LCD and a cover of the laptop computer, or a frame for supporting and protecting the LCD, or a shielding (not shown) at the back of the LCD for preventing an Electro Magnetic Interference (EMI) of other electronic components (not shown), or other possible positions in the electronic device.

Figure 1:
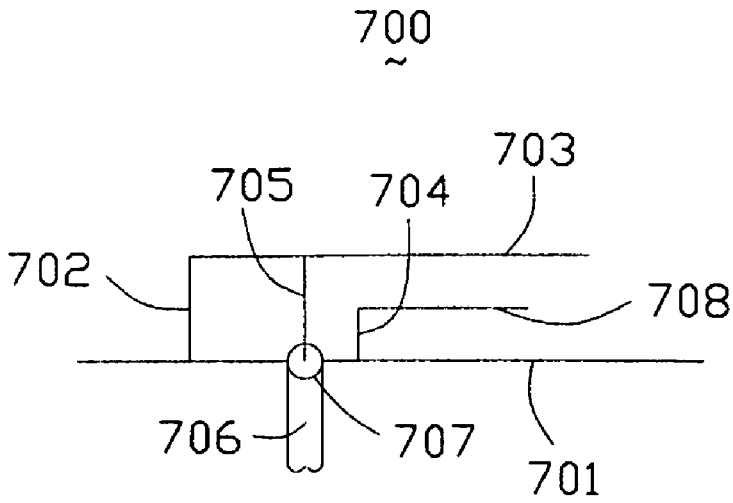
FIG. 1 (PRIOR ART)
FIG. 1 is a plan view of a conventional dual-band antenna in accordance with the prior art.
Figure 2:
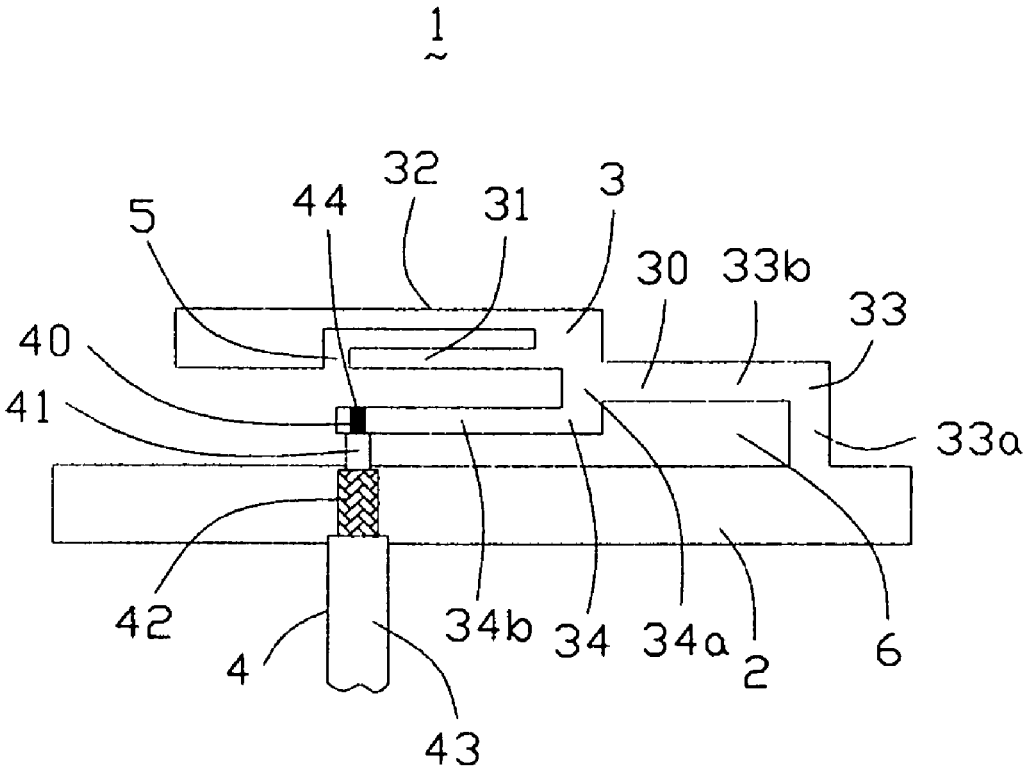
FIG. 2 is a plan view of a preferred embodiment of a multi-band antenna in accordance with the present invention.

Referring to FIG. 2, the multi-band antenna 1 comprises a ground portion 2, a radiating portion 3 and a coaxial transmission line 4.

The radiating portion 3 comprises a first radiating portion 30, a second radiating portion 31 and a third radiating portion 32. The first radiating portion 30, the second radiating portion 31 and the third radiating portion 32 are connected with each other and are coplanar with each other. The second and third radiating portions 31 and 32 are both essentially horizontally extending from a common conjunction (not labeled) of said three radiating portions 30, 31 and 32. The second and the third radiating portions 31 and 32 are arranged above the first radiating portion 30. The second and the third radiating portions 31 and 32 essentially form as a rectangular shape. The second and the third radiating portions 31 and 32 define a slit 5 therebetween. In this preferred embodiment, the slit 5 is inverted-L shaped. The third radiating portion 32 is L-shaped and defines a longer signal path than the second radiating portion 31. The first radiating portion 30 comprises a first section 33 and a second section 34. The two sections 33 and 34 meet at said conjunction. The first section 33 of the first radiating portion 30 connects the second and the third radiating portions 31 and 32 with the ground portion 2. The first section 33 comprises a first strip 33*a* upwardly extending from the ground potion 2 and a second strip 33*b* horizontally extending from the first strip 33*a*. The second section 34 comprises a third strip 34*a* downwardly extending from the second strip 33*b* and a forth strip 34*b* horizontally extending from the third strip 34*a*. The first strip 33*a* and the third strip 34*a* are parallel to each other. The second strip 33*b* and the forth strip 34*b* are parallel to each other. The third strip 34*a* is shorter than the first strip 33*a*. The forth strip 34*b* is lower than the second strip 33*b*. The first radiating portion 30 and the ground portion 2 define a space 6 therebetween. In this preferred embodiment, the space 6 is inverted-L shaped. A feeder 44 is disposed on a tail end of the forth strip 34*b*.

The coaxial transmission line 4 successively comprises an inner conductor 40, an inner insulator 42, a braided layer 41 and an outer insulating jacket 43. The inner conductor 40 is electrically connected with the feeder 44 of the forth strip 34*b*. The braided layer 41 is electrically connected with the ground portion 2.

The first radiating portion 30, the second radiating portion 31, the ground portion 2 and the coaxial transmission line 4 corporately form a first planar inverted-F antenna. The first planar inverted-F antenna operates at a higher frequency band of about 5.15–5.875 GHz. The first radiating portion 30, the ground portion 2 and the coaxial transmission line 4 corporately form a loop antenna. The loop antenna also operates at a higher frequency band of about 5.725–5.875 GHz. The first radiating portion 30, the third radiating portion 32, the ground portion 2 and the coaxial transmission line 4 corporately form a second planar inverted-F antenna. The second planar inverted-F antenna operates at a lower frequency band of about 2.4–2.5 GHz. The first planar inverted-F antenna and the loop antenna operate at either the same frequency band or different frequency bands. The impedance match of the first and the second planar inverted-F antenna can be tuned by tuning the length or shape of the first section 33.

Figure 3:
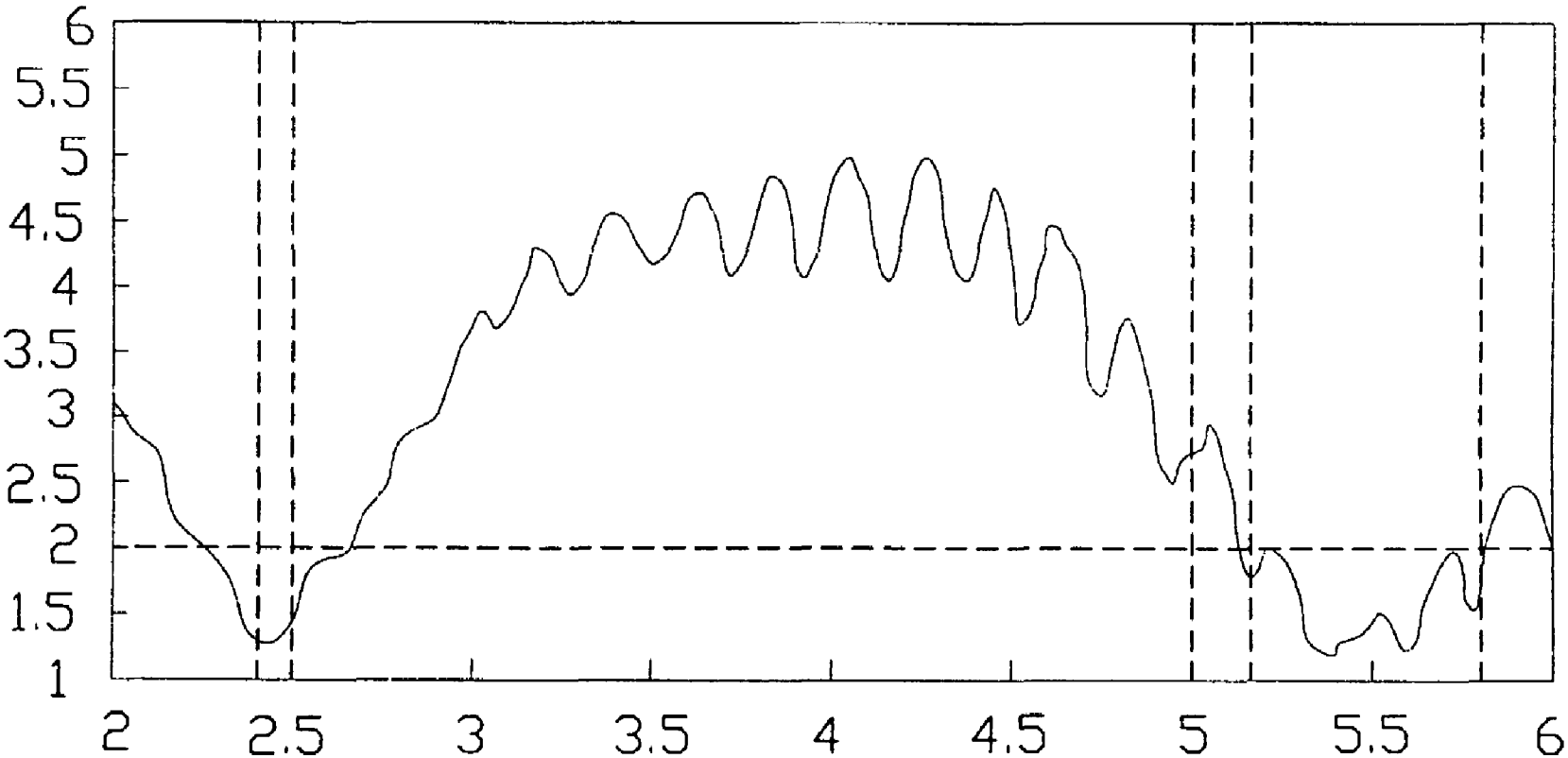
FIG. 3 is a test chart recording of Voltage Standing Wave Ratio (VSWR) of the multi-band antenna as a function of frequency.
Figure 4:
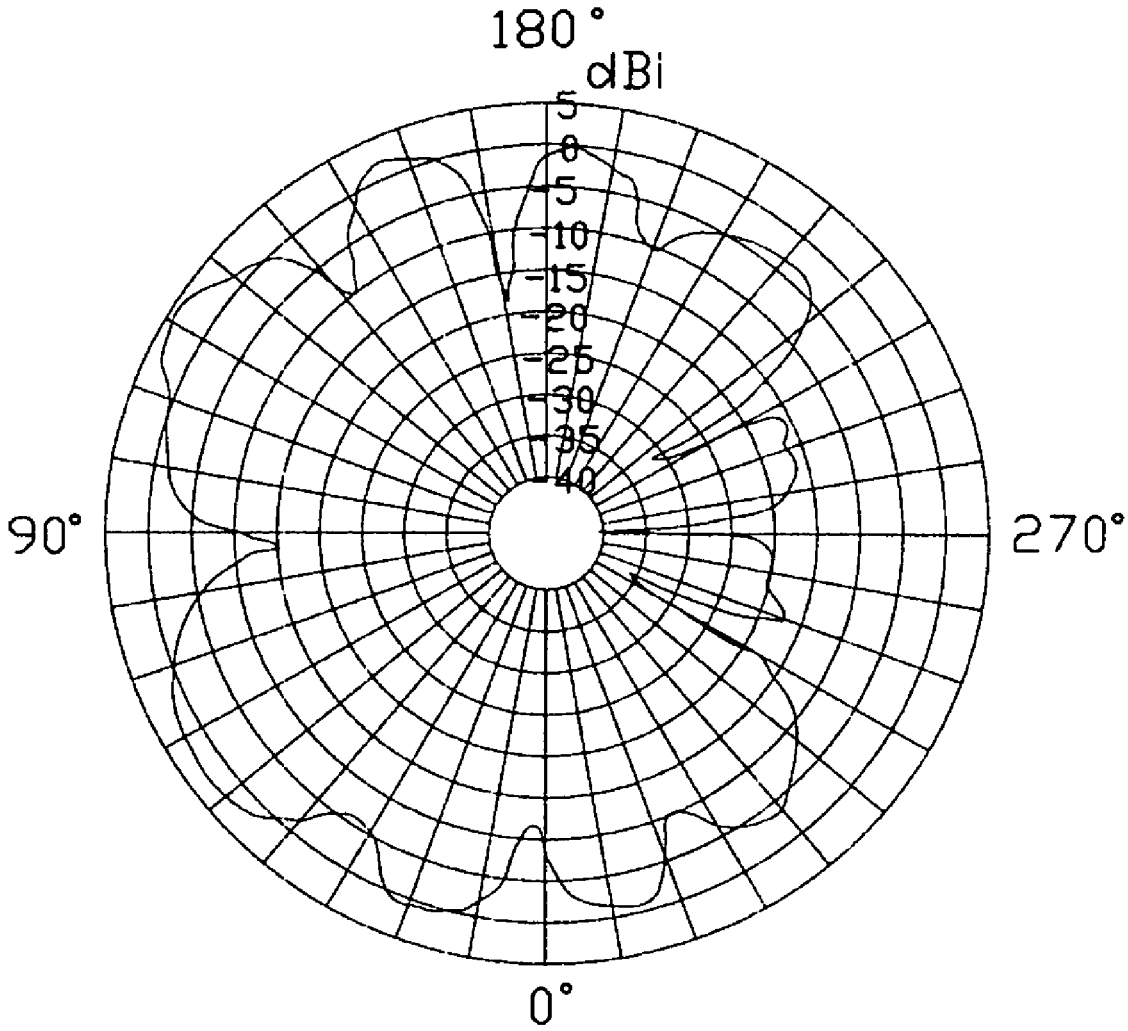
FIG. 4 is a horizontally polarized principle plane radiation pattern of the antenna operating at the resonant frequency of 2.5 GHz.
Figure 5:
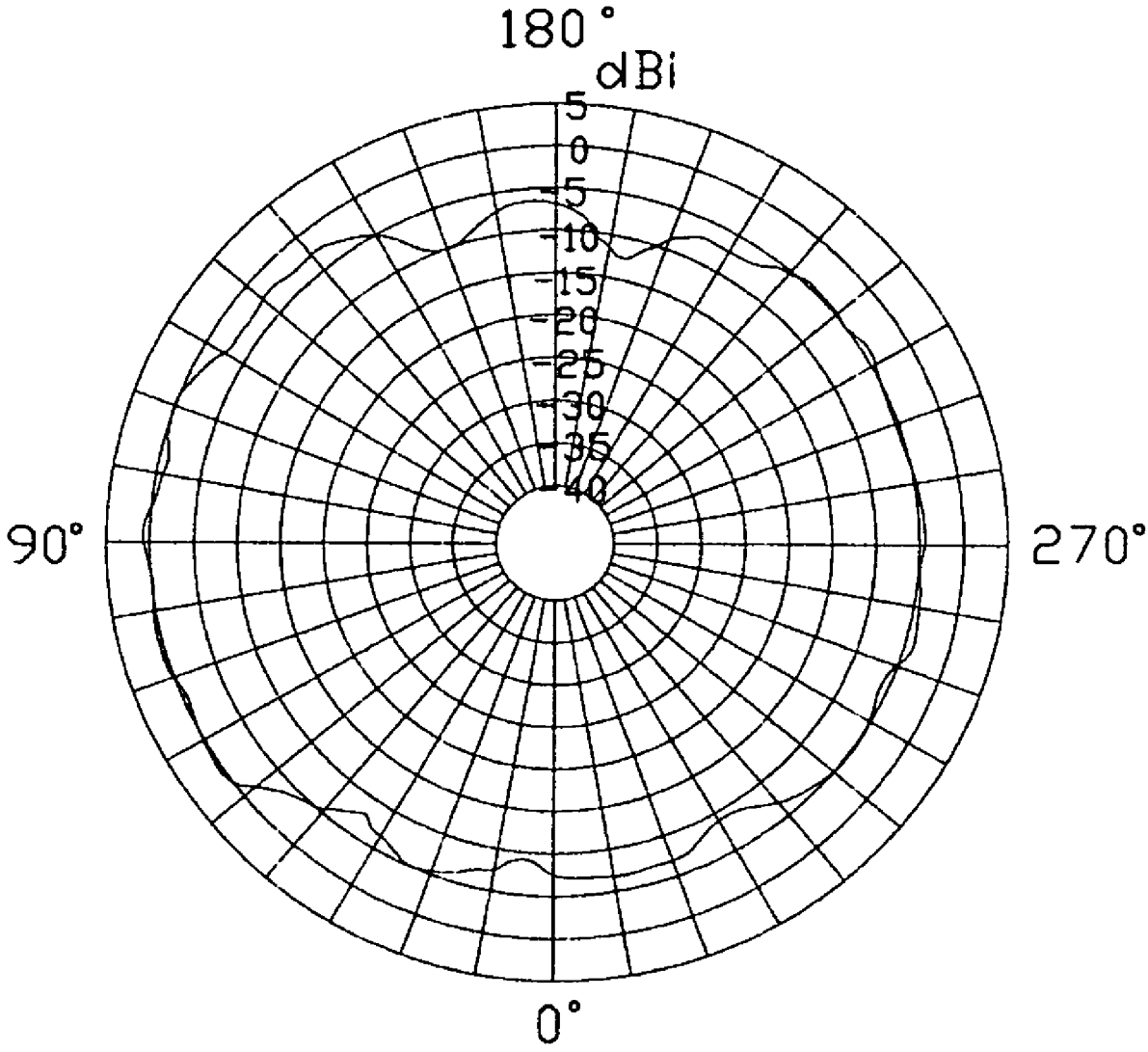
FIG. 5 is a vertically polarized principle plane radiation pattern of the antenna operating at the resonant frequency of 2.5 GHz.
Figure 6:
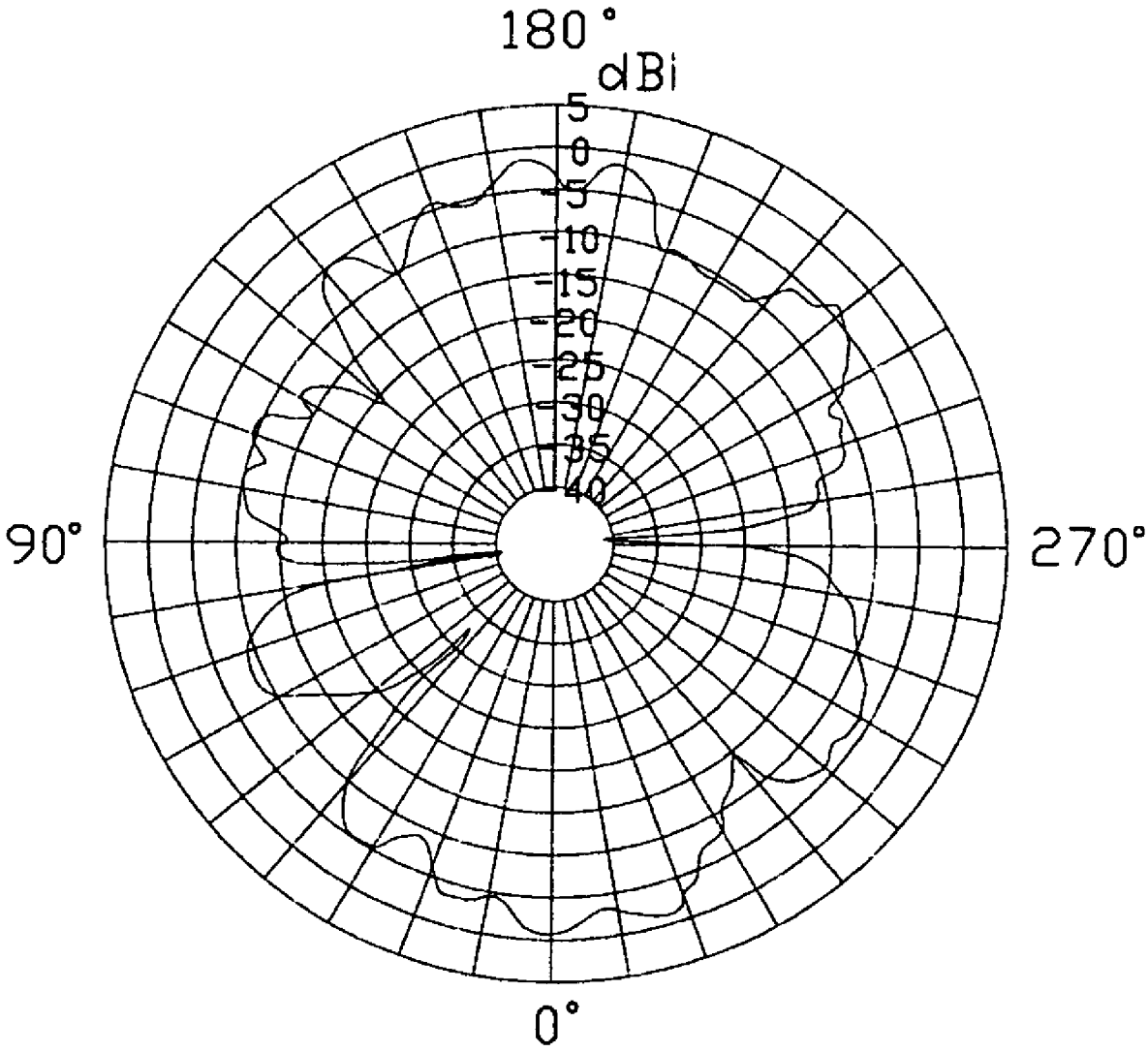
FIG. 6 is a horizontally polarized principle plane radiation pattern of the antenna operating at the resonant frequency of 5.35 GHz.
Figure 7:
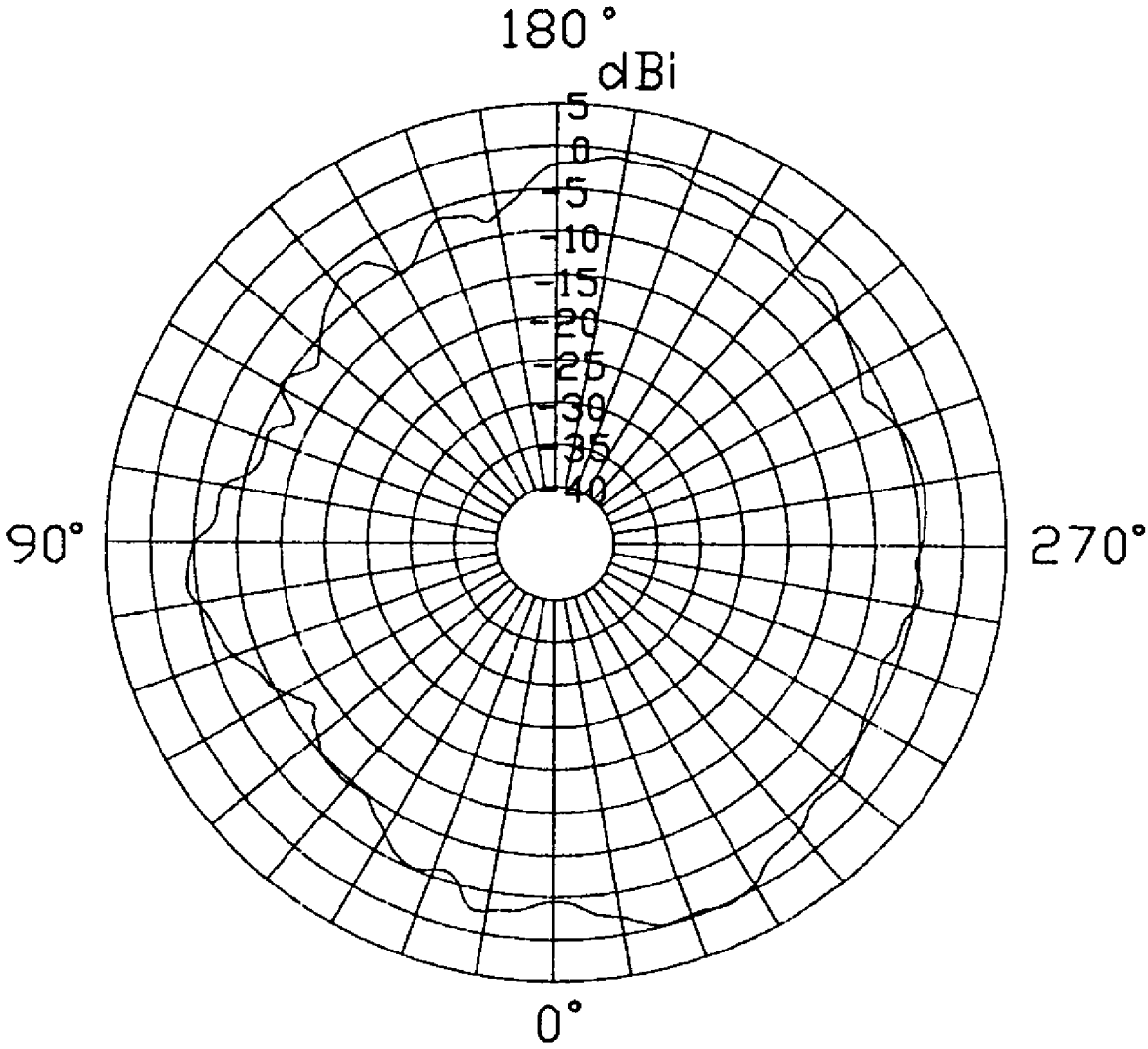
FIG. 7 is a vertically polarized principle plane radiation pattern of the antenna operating at the resonant frequency of 5.35 GHz.
Figure 8:
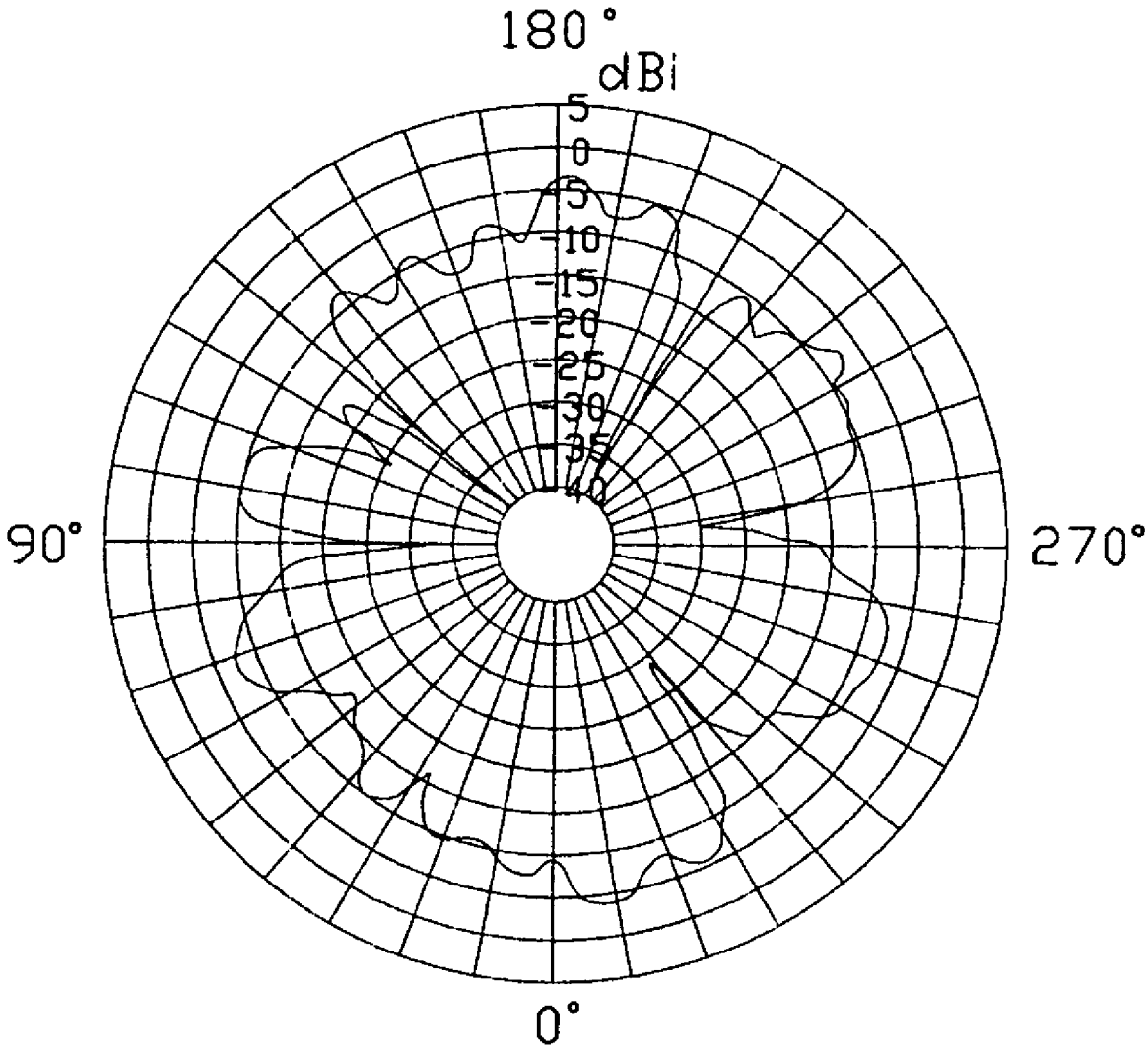
FIG. 8 is a horizontally polarized principle plane radiation pattern of the antenna operating at the resonant frequency of 5.875 GHz.
Figure 9:
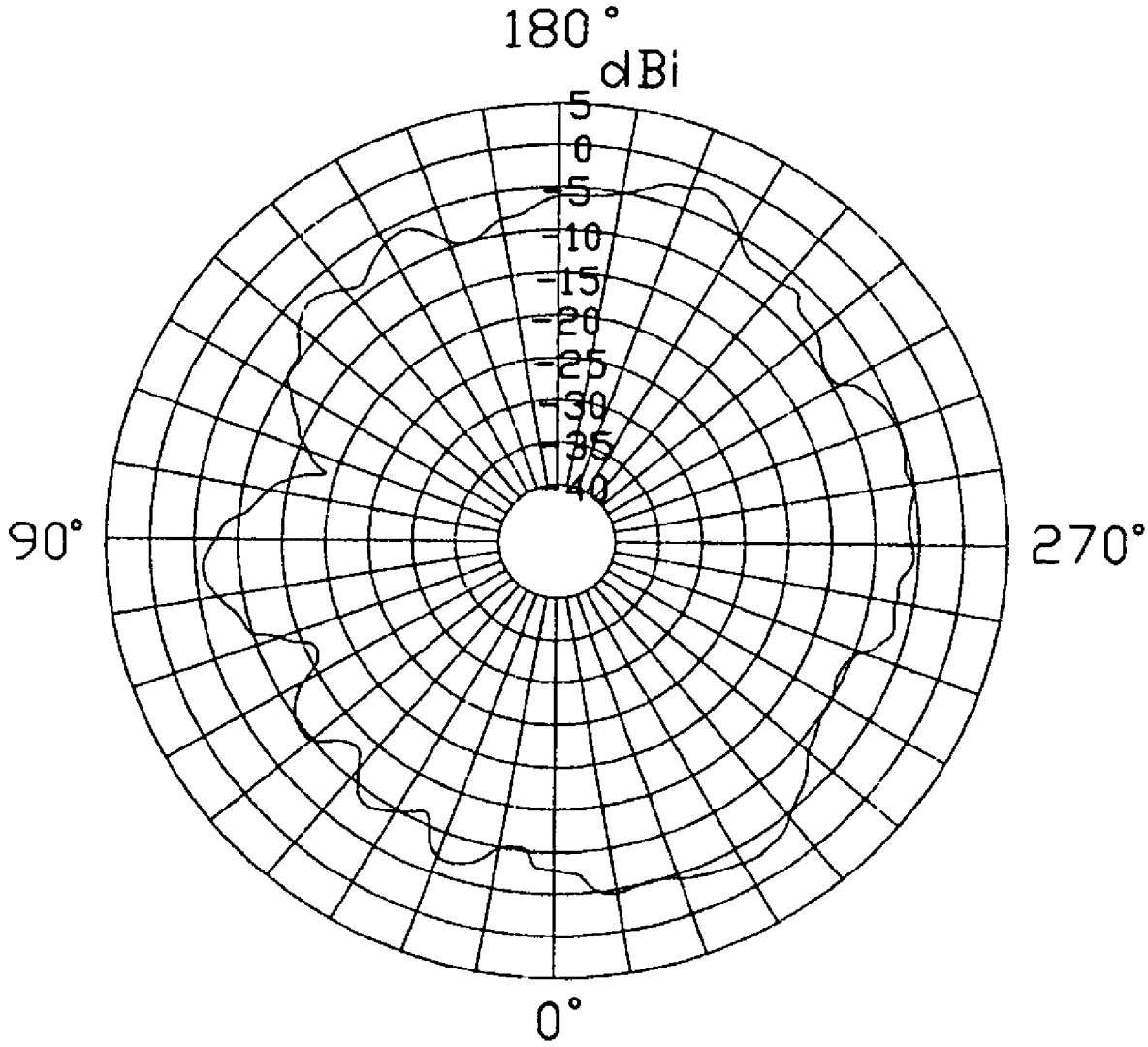
FIG. 9 is a vertically polarized principle plane radiation pattern of the antenna operating at the resonant frequency of 5.875 GHz.

In terms of this preferred embodiment, the performance of the multi-band antenna 1 is excellent. In order to illustrate the effectiveness of the present invention, FIG. 3 sets forth a test chart recording of Voltage Standing Wave Ratio (VSWR) of the multi-band antenna 1 as a function of frequency. Note that VSWR obviously drops below the desirable maximum value "2" in less than 2.4 G to more than 2.5 GHz frequency band and in 5.15 G–5.875 GHz, indicating acceptable efficient operation in these two frequency bands, which separately covers the bandwidth of wireless communications under IEEE 802.11b/g standard and IEEE 802.11a standard.

FIGS. 4–9 show the horizontally polarized and vertically polarized principle plane radiation patterns of the multi-band antenna 1 operating at the resonant frequency of 2.5 GHz, 5.35 GHz and 5.875 GHz. Note that the each radiation pattern of the multi-band antenna 1 is close to corresponding optimal radiation pattern and there is no obvious radiating blind area, conforming to the practical use conditions of an antenna.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a radiating portion;

a ground portion; and a coaxial transmission line;

wherein the radiating portion, the ground portion and the coaxial transmission line cooperatively form a plurality of antennas meeting at a common junction, said plurality of antennas being coplanar with each other and being all fed by the same coaxial transmission line, the multi-band antenna is formed of a metallic sheet by defining a plurality of holes therein.

2. The multi-band antenna as claimed in claim 1, wherein one of the plurality of holes is inverted-L shaped.

3. The multi-band antenna as claimed in claim 1, wherein the radiating portion comprises a first radiating portion, a second radiating portion and a third radiating portion.

4. The multi-band antenna as claimed in claim 1, wherein the radiating portion comprises a first section connecting the radiating portion with the ground portion.

5. The multi-band antenna as claimed in claim 1, wherein the plurality of antennas comprises a first inverted-F antenna, a second inverted-F antenna and a loop antenna.

6. The multi-band antenna as claimed in claim 5, wherein the first inverted-F antenna and the loop antenna are operated at a higher frequency band, while the second inverted-F antenna is operated at a lower frequency band, the first inverted-F antenna and the loop antenna operating at the same frequency band.

7. The multi-band antenna as claimed in claim 5, wherein the first inverted-F antenna and the loop antenna are respectively operated at different higher frequency bands, while the second inverted-F antenna is operated at a lower frequency band.

8. A multi-band antenna, comprising:

a first antenna having a first radiating portion;

a second antenna having a second radiating portion;

a third antenna having a third radiating portion; and a feeder;

wherein said first, second and third antennas have a common ground portion and a collective feeder, and said first, second and third radiating portions are connected with each other, the second and the third radiating portions define an inverted-L shaped slit therebetween.

9. The multi-band antenna as claimed in claim 8, wherein the second and the third radiating portions are arranged above the first radiating portion.

10. The multi-band antenna as claimed in claim 8, wherein the first antenna is a loop antenna.

11. The multi-band antenna as claimed in claim 8, wherein the second antenna is an inverted-F antenna.

12. The multi-band antenna as claimed in claim 8, wherein the third antenna is an inverted-F antenna.

13. The multi-band antenna as claimed in claim 8, wherein the first radiating portion and the ground portion define an inverted-L shaped space therebetween.

14. The multi-band antenna as claimed in claim 8, wherein the third radiating portion is L-shaped and defines a longer signal path than the second radiating portion.

15. The multi-band antenna as claimed in claim 8, wherein the second and the third radiating portions essentially form as a rectangular shape in structure.

16. The multi-band antenna as claimed in claim 8, wherein the first radiating portion comprises a first section connecting the second and the third radiating portions with the ground portion.

17. A multi-band antenna comprising:

a common ground portion;

a first radiation section extending from an upward edge of the ground portion;

essentially parallel spaced second and third radiation section joined at a distal end of the first radiation section, said radiation section being closer to the ground portion than the third radiation section; and a feeder cable including an outer connected to the ground portion and an inner conductor connected to the second radiation section.

18. The multi-band antenna as claimed 17, wherein said first radiation section is of a downwardly lying L-shaped configuration.

* * * * *